US007401854B2

(12) United States Patent
Adams

(10) Patent No.: US 7,401,854 B2
(45) Date of Patent: Jul. 22, 2008

(54) STACKABLE FOLDING CHAIR

(75) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 87 days.

(21) Appl. No.: 11/206,534

(22) Filed: Aug. 18, 2005

(65) Prior Publication Data

US 2006/0163920 A1 Jul. 27, 2006

Related U.S. Application Data

(63) Continuation-in-part of application No. 29/221,923, filed on Jan. 21, 2005, now Pat. No. Des. 509,970.

(51) Int. Cl.
*A47C 3/04* (2006.01)

(52) U.S. Cl. ..... 297/239; 297/38; 297/39; 297/40; 297/54

(58) Field of Classification Search ..... 297/19, 297/27, 28, 31, 38 X, 39 X, 40 X, 46, 47, 297/239 OR, 16.1, 21, 22, 51–54, 54 X, 38, 297/39, 40, 239
See application file for complete search history.

(56) References Cited

U.S. PATENT DOCUMENTS

| | | | | | |
|---|---|---|---|---|---|
| 909,820 | A | * | 1/1909 | Rabich | 297/38 |
| 924,396 | A | * | 6/1909 | Spoljar | 297/54 |
| 1,984,238 | A | * | 12/1934 | Spanopoulos | 297/54 |
| 2,072,075 | A | | 2/1937 | Travers | |
| D109,239 | S | | 4/1938 | Wolpin | |
| 2,192,672 | A | | 3/1940 | Connor, Jr. | |
| 2,222,296 | A | | 11/1940 | Arnold | |
| 2,517,039 | A | * | 8/1950 | Shook | 297/51 |
| 2,600,626 | A | | 6/1952 | Ellingson | |
| 2,603,273 | A | | 7/1952 | Gambrill | |
| 2,650,652 | A | | 9/1953 | Watson | |
| 3,031,227 | A | * | 4/1962 | Van Buren, Jr. | 297/239 |
| 3,083,995 | A | * | 4/1963 | Bradshaw et al. | 297/39 |
| 4,522,446 | A | | 6/1985 | Sheridan | |

(Continued)

FOREIGN PATENT DOCUMENTS

| | | |
|---|---|---|
| CA | 2158396 | 3/1996 |

OTHER PUBLICATIONS

Web page thewoodcrafter.net "Build this Adirondack Style Folding Lawn Chair".

*Primary Examiner*—Laurie K Cranmer
(74) *Attorney, Agent, or Firm*—Buchanan Ingersoll & Rooney PC

(57) ABSTRACT

A stackable folding chair has a seat and a back pivotably attached to the rear edge of the seat. Front legs are pivotably attached at right and left edges of the seat. Rear legs are pivotably attached to the bottom of the seat. Armrests are pivotably attached to the seat back and adjustably attached to the front legs. The rear legs are pivotable relative from an extended position a folded position in which the rear legs are substantially parallel to and beneath the seat. Adjustable attachment of the armrests to the front legs allows the angle of the seat back to be adjusted as well as enabling the front legs and seat back to fold substantially parallel to the seat. The stackable folding chair preferably injected molded from plastic.

12 Claims, 6 Drawing Sheets

U.S. PATENT DOCUMENTS

| | | | | |
|---|---|---|---|---|
| 4,635,998 | A | 1/1987 | Hickey | |
| 4,707,023 | A | 11/1987 | Hickey | |
| 4,890,881 | A | 1/1990 | Ollat et al. | |
| 4,906,046 | A * | 3/1990 | Kleinklaus | 297/359 |
| 4,976,492 | A | 12/1990 | Ziegler | |
| D319,354 | S | 8/1991 | Wolcott | |
| 5,096,259 | A * | 3/1992 | Stanfield | 297/239 |
| 5,120,071 | A | 6/1992 | Thibault et al. | |
| D334,299 | S | 3/1993 | Embree | |
| 5,375,906 | A * | 12/1994 | Snyder | 297/39 |
| D366,771 | S | 2/1996 | Lyons | |
| 5,511,849 | A | 4/1996 | Cahaley et al. | |
| D384,511 | S | 10/1997 | Gresens | |
| D407,227 | S | 3/1999 | Walters | |
| D407,228 | S | 3/1999 | Walters | |
| D413,452 | S | 9/1999 | Rhienen | |
| 6,412,869 | B1 * | 7/2002 | Pearce | 297/294 |
| 6,698,828 | B1 * | 3/2004 | Chan | 297/54 |
| D503,550 | S | 4/2005 | Miesieski et al. | |

* cited by examiner

STACKABLE FOLDING CHAIR

CROSS REFERENCE TO RELATED APPLICATION

This is a continuation-in-part of U.S. patent application Ser. No. 29/221,923 now U.S. Pat. No. D,509,970.

FIELD OF THE INVENTION

The invention relates generally to folding chairs and stackable chairs.

BACKGROUND OF THE INVENTION

Folding chairs of various types are well known. Such chairs typically have a seat which is pivotably attached to legs such that the seat can be pivoted from an open position for sitting to a folded position for storage. Many such folding chairs have a seat back connected between the pair of legs. The advantage of these chairs is that they can be stored in a relatively small space when in a folded condition.

Another type of chair, popular for use as outdoor furniture, is a molded plastic chair. These chairs are a single molded structure and are usually configured so that one chair may be stacked on another chair.

Stackable chairs have an advantage in that they can be stacked upon one another and placed on a pallet for easy transport. A retailer may display the stacked chairs on the same pallet on which they have been shipped. Consumers may also store several stackable chairs stacked one upon another. While the stackability is an advantage for storage and display, larger stackable chairs are disliked by consumers because they will not fit into many automobiles. Consequently, there is a need for a chair which is both stackable and can be folded. Such a chair would fit into most family cars when folded.

Adirondack chairs are a larger type of chair and are very popular. These chairs tend to be either a single molded unit or a wooden chair in which the pieces of the chair are nailed together to form a single unit. Most wooden Adirondack chairs are not foldable, and are also very difficult to stack. Indeed, the only method of stacking such an Adirondack chair is to place one chair in an upright position and the invert the second chair and place it over the first chair. Consequently, there is a need for an Adirondack chair which is both stackable and foldable.

SUMMARY OF THE INVENTION

A stackable folding chair is provided having a seat and a seat back pivotably attached to the rear edge of the seat. A front pair of legs are attached to respective right and left edges of the seat, and a pair of rear legs are pivotably attached to the bottom of the seat at the rear edge of the seat, such that the rear legs can be pivoted from a position generally perpendicular, or at an obtuse angle, relative to the seat to a position at which the rear legs are folded substantially parallel to and beneath the seat. Preferably the front legs are also pivotably attached to the edges of the seat.

The chair also has a pair of armrests which are pivotably attached to the seat back and are adjustably attached to the upper end of the front legs. In one embodiment, adjustment of the armrests relative to the front legs allows the seat back to be set at different angles relative to the seat, and also enables the seat back and front legs to be folded substantially parallel to the seat. In another embodiment, the seat back has only two positions, folded for storage and open for sitting. Reinforcing bars can be attached to the bottom of the seat to enhance strength.

The stackable folding chair is preferably an injected molded plastic product. Preferably, the plastic is polypropylene, polyvinylchloride polycarbonate or ABS. If desired, the plastic may also be reinforced with fiberglass or filled with other materials commonly used in the industry.

Other objects and advantages of the present invention will become apparent from a description of certain presently preferred embodiments shown in the figures.

DETAILED DESCRIPTION OF THE PREFERRED EMBODIMENTS

Figure 5:
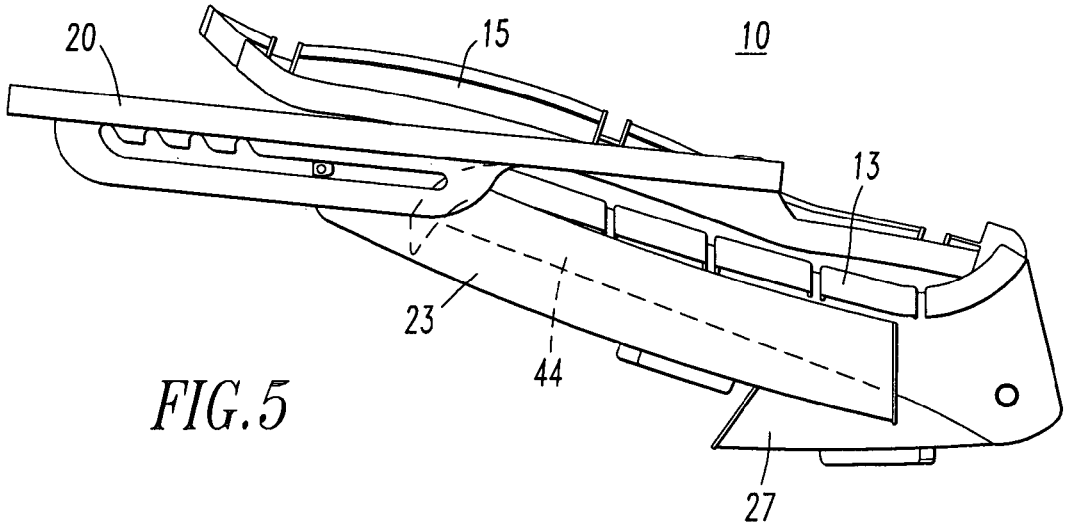
FIG. 5 is a left side view, with the backrest and rear legs folded against the seat.
Figure 6:
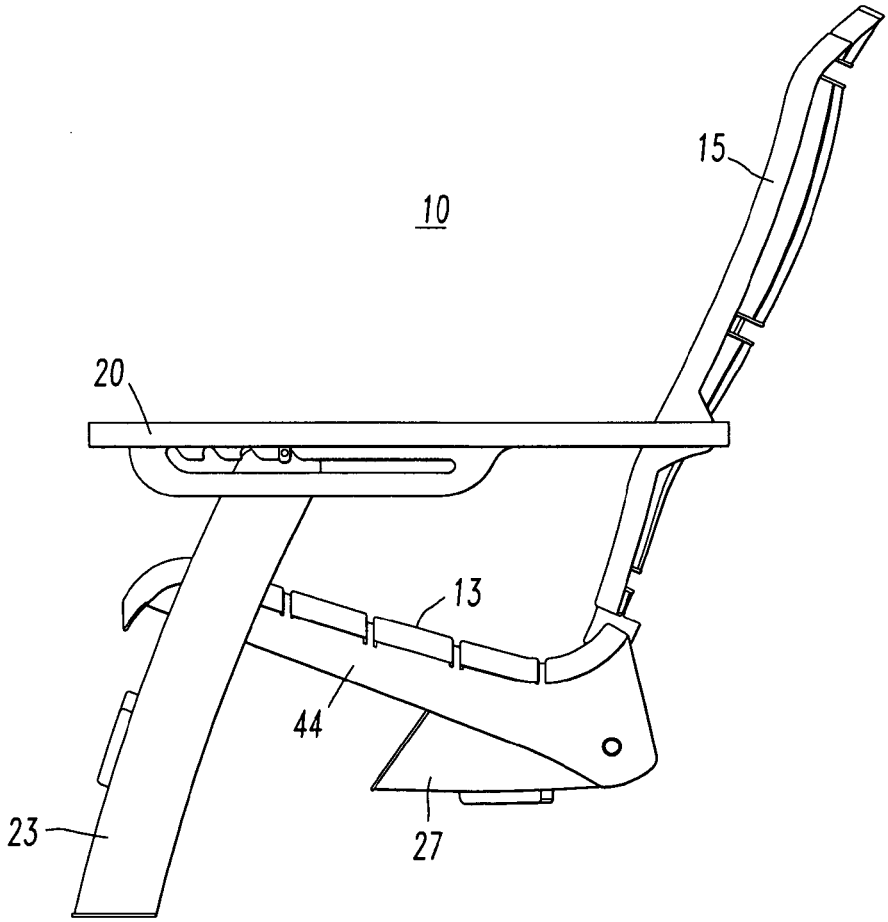
FIG. 6 is a left side view of the embodiment of FIG. 2, with the only the rear legs folded against the seat.

Referring now to the drawing figures, wherein like reference numbers designate like elements, a present preferred embodiment of a stackable folding Adirondack style chair 10 is illustrated. The chair 10 has a seat 13, a seat back 15 pivotably attached to a rear edge 17 of the seat 13, and a pair of armrests 20, 21. The seat 13 is supported at or near the front edge by a pair of front legs 23, 25. One leg is attached at right edge 18 and the other leg is attached at left edge 19 of the seat 13. The front legs 23, 25 can be pivotably attached to the edges of the seat 13. The front legs 23, 25 can be pivoted to a folded position substantially parallel to and adjacent the right and left edges of the seat 13 as shown in FIG. 5. A pair of rear legs 27, 29 support the seat 13 at or near the rear edge 17, and are pivotably attached to the bottom 44 of the seat 13, such that the rear legs 27, 29 can be pivoted to a folded position substantially parallel to and underneath the seat 13 as shown in FIGS. 5 and 6.

Figure 3:
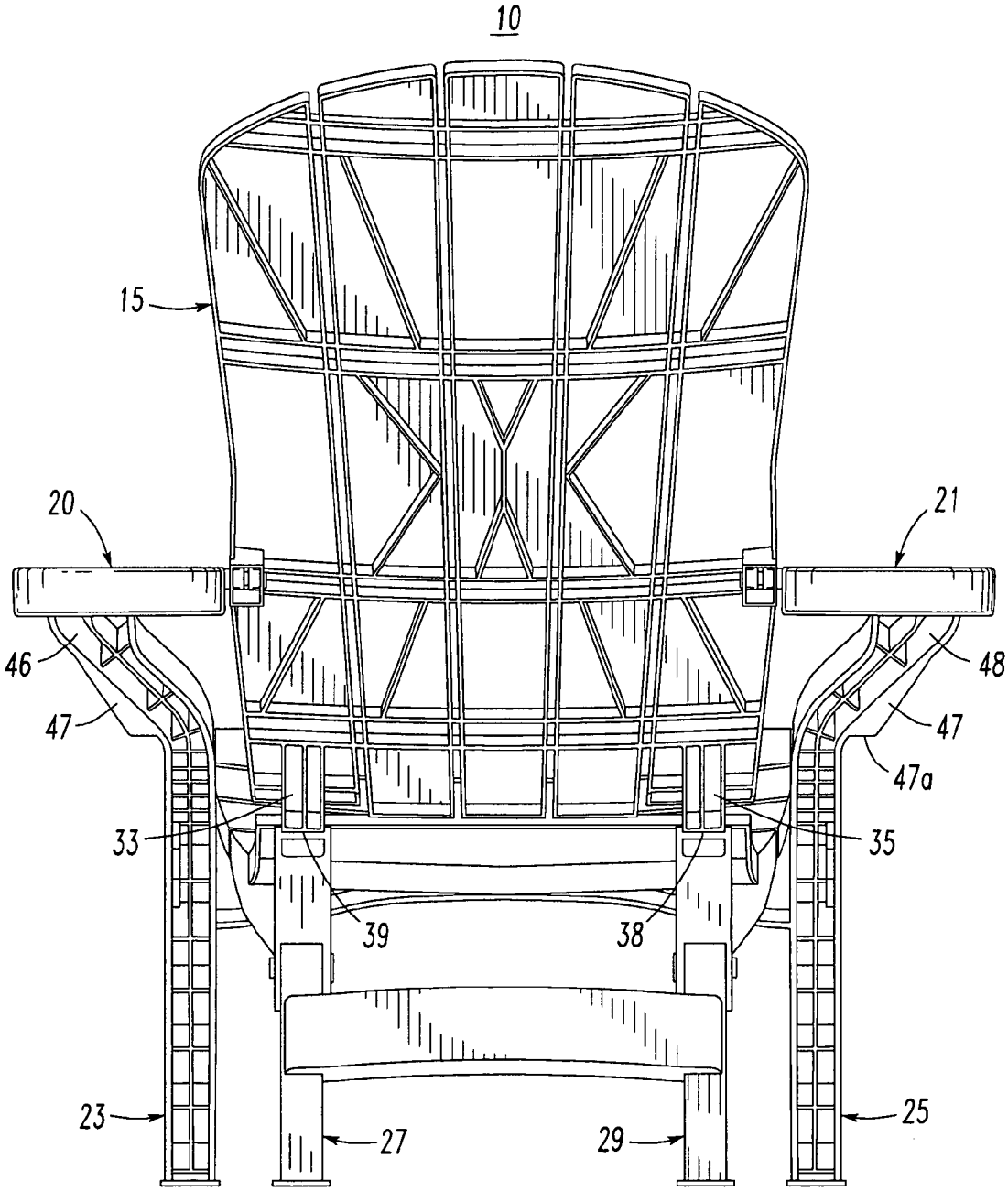
FIG. 3 is a back view of the embodiment shown in FIG. 2.
Figure 4:
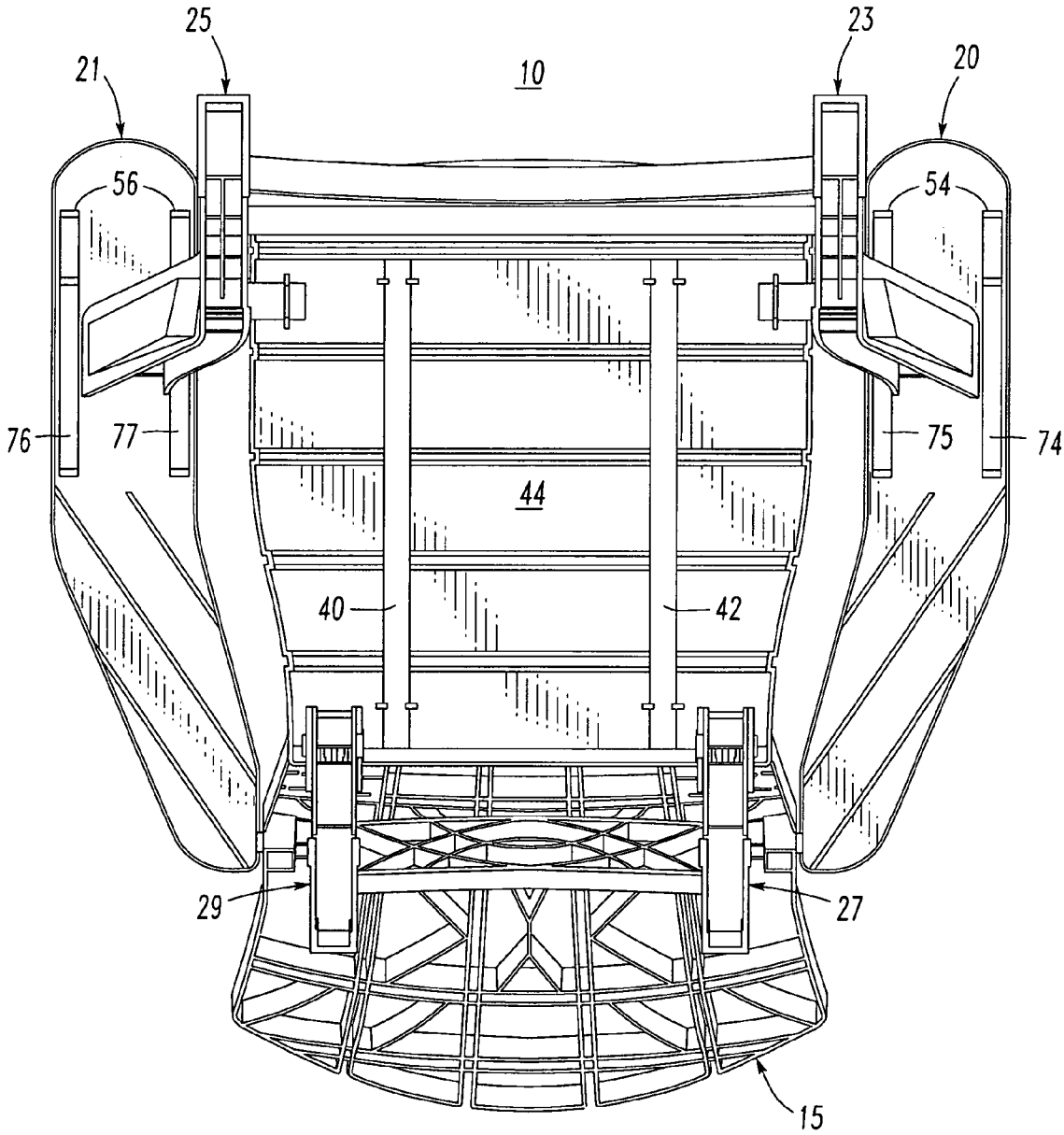
FIG. 4 is a bottom view of the embodiment shown in FIG. 2.

The pivotal attachment of the seat back 15 to the lower edge 17 of the seat 13 permits the seat back 15 to be folded toward the top surface of the seat 13, in a position substantially parallel to the seat 13. In particular, the lower edge 31 of the seat back 15 can be hinged to the rear edge 17 of the seat 13 in a known manner. For example, as illustrated in FIGS. 3 and 4, a pair of hinge portions 33, 35 project from the lower edge 31 of the seat back 15, at spaced apart locations thereon. These hinge portions 33, 35 are pivotably captured in respective, correspondingly spaced apart notches 38, 39 provided in the rear edge 17 of the seat 13.

Figure 1:
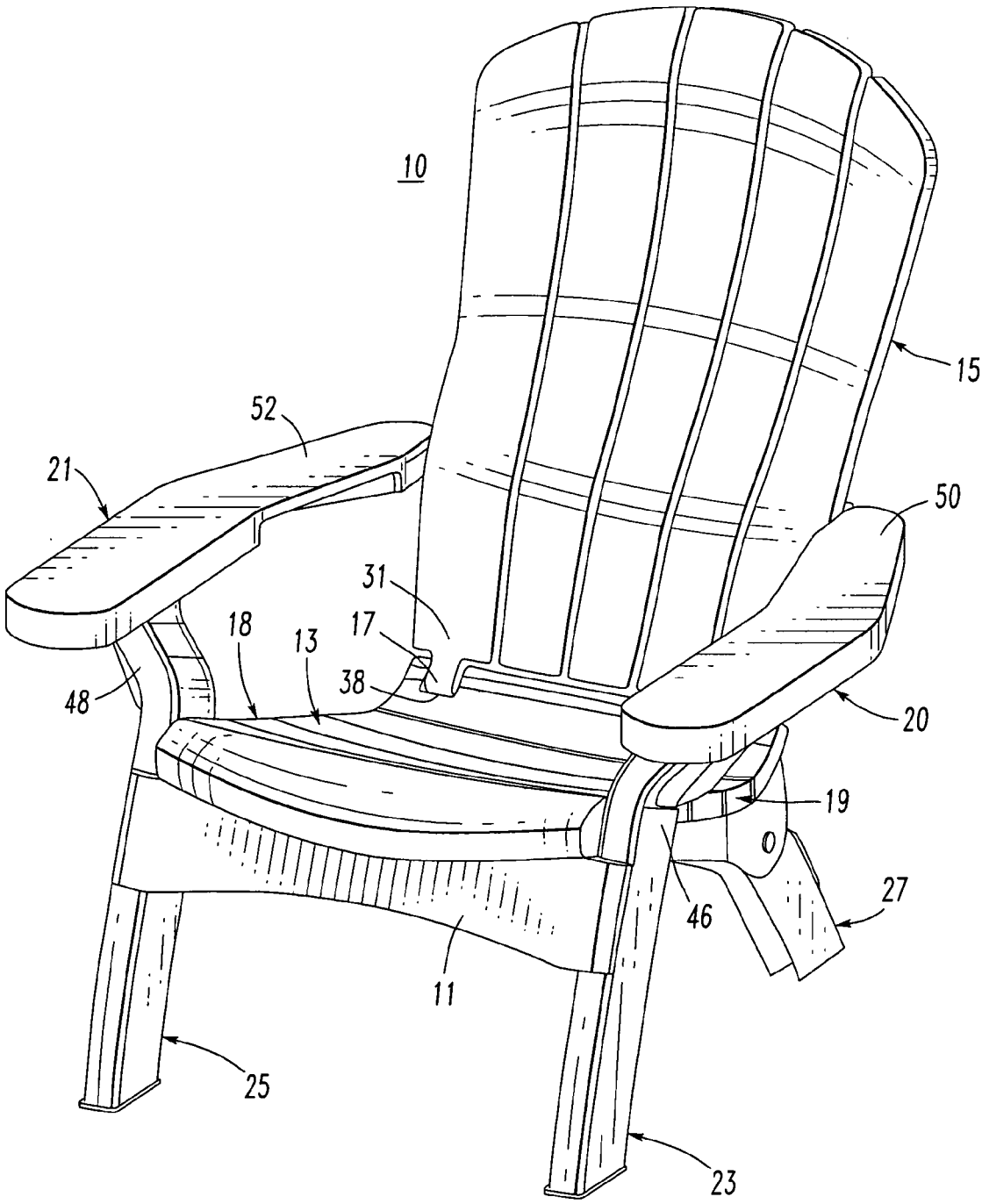
FIG. 1 is a front perspective view of a stackable folding chair according to the invention.
Figure 2:
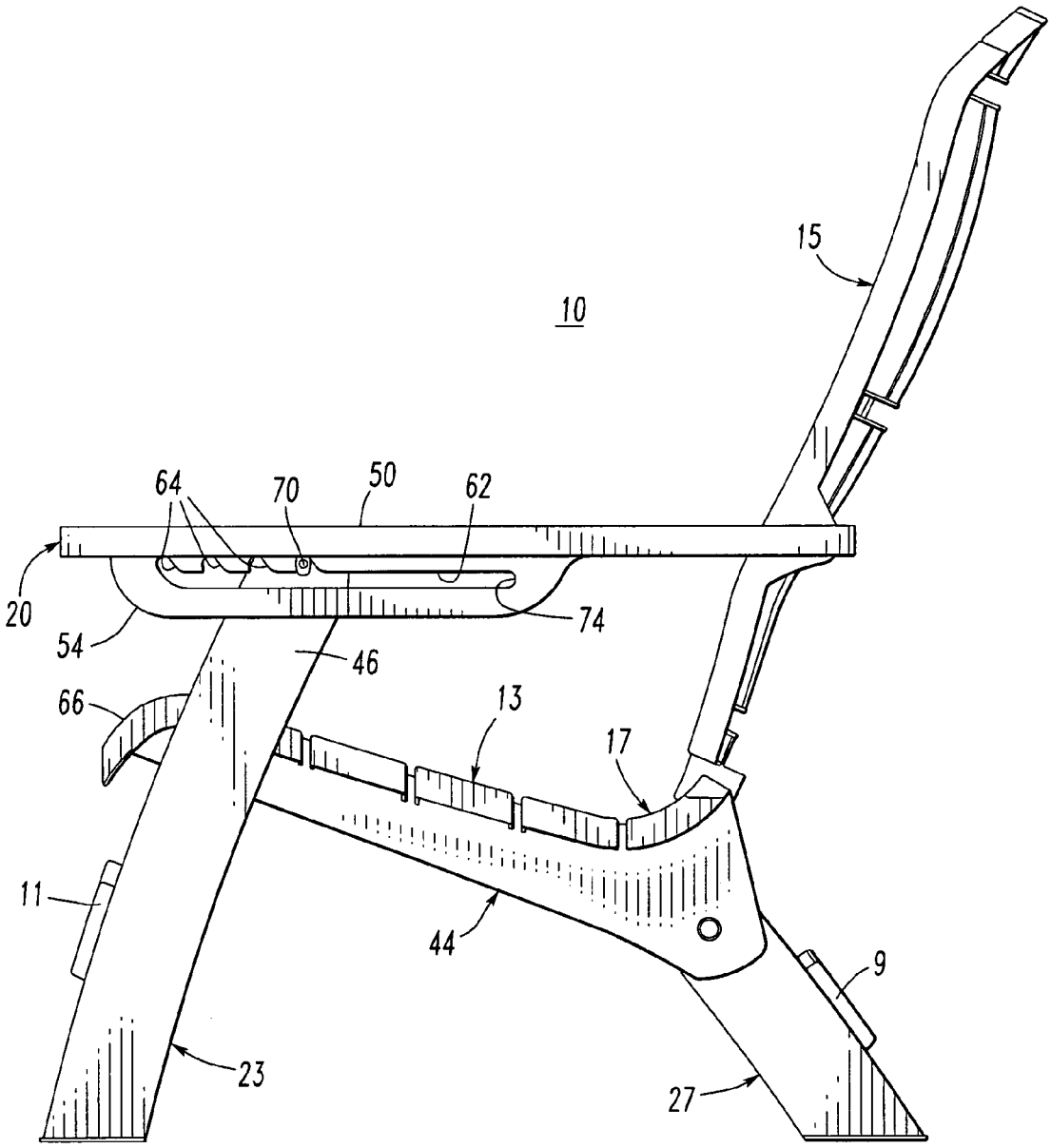
FIG. 2 is a left side view of the chair in FIG. 1 with the front cross brace in a lower position, the right side view being a mirror image.

I prefer to provide a cross member or brace 11 between the front legs 25, 23. The cross member may be positioned as in FIGS. 1 and 7 so the seat rests on the cross member. Alternatively, the cross member can be lower on the legs as shown in FIG. 2. The cross member prevents the legs from splaying outward. A similar cross member 9 can be provided between the rear legs.

The stackable folding chair 10 is preferably an injected molded plastic product. Preferably, the plastic is polypropylene, polyvinyl chloride, polycarbonate or ABS. If desired, the plastic may also be reinforced with fiberglass or other materials commonly used in the industry. As can be seen in FIG. 4, reinforcing bars 40, 42 can be attached to the bottom 44 of the seat 13 to provide increased strength.

The armrests 20, 21 can be pivotably connected to both the seat back 15 and the front legs 23, 25. The front end of the armrest 20 is attached to the upper end 46 of the front leg 23 by a pin and slot arrangement commonly used in folding chairs. The opposite end of the armrest 20 is pivotably attached to the side of the seat back 15 above the hinged attachment of the seat back 15 to the rear edge 17 of the seat 13. The armrest 20 preferably has an upper support surface 50 and a flange 54, which projects downwardly from, and generally perpendicular to, the upper surface 50. The flange 54 extends along the bottom of the upper surface 50 of the armrest 20 and has a slot 61 provided therein which extends substantially the length of the flange 54. In general, the length of the slot 62 is determined with regard to the length required to enable the seat back 15 to fold substantially flat against the top of the seat 13, in a manner which will be described in more detail hereinafter.

A plurality of notches 64 are provided in the flange 54, in the upper edge of the slot 62, and are generally located toward the front of the flange 54, i.e., toward the front edge 66 of the seat 13. The notches 64 define different positions at which the armrest 20 may be set relative to the front leg 23. The upper end 46 of the front leg 23 is pivotably attached to the flange by a pin 70 which extends perpendicularly from the upper portion 46 of the front leg 23. A distal end of the pin 70 is slidably captured in the slot 62 in the flange 54. This manner of attachment of the armrest 20 between the seat back 15 and the front leg 23 allows the angle of the seat back 15 can be adjusted by manipulating the armrests 20, 21.

As can be understood from FIG. 2, lifting upwardly on the armrest 20 moves the pin 70 out of one of the notches 64 in which it is captured. At this point, the pin will slide freely in the slot 62, forward or backward, either to another of the notches 64, or to all the way to a rear boundary 74 of the slot 62. When the desired angle of the seat back 15 is obtained, the armrest 20 is then moved downwardly again to capture the pin 70 in an adjacent one of the notches 64. At that point the armrest 20, and the seat back 15 are locked, at the selected location. Movement of both armrests 20, 21 forward and backward in this manner rotates the seat back 15 about the hinged connected between the seat 13 and the seat back 15, changing the angle of the seat back 15 relative to the seat 13. Thus, the angle of the seat back 15 can be conveniently changed and locked in the desired position simply by manipulating the armrests 20, 21 in the manner described.

In another embodiment of the chair only one flange is provided in the armrest. Consequently, the seat back in this chair can only be in one position for sitting.

Referring to FIG. 4, in a preferred embodiment of the armrests each flange 54, 56, is a pair of parallel, spaced apart walls. In particular, flange 54 is formed by a pair of walls 74, 75 on the underside of the support surface 50 of the left armrest 20, and flange 56 is formed by a pair of walls 76, 77 on the underside of the support surface 52 of the left armrest 21. The upper end 46, 48 of each front leg 23, 25, fits between the walls 74, 75 and 76, 77, respectively. A pin 70 connects the upper ends 46, 48 of each front leg 23, 25 between each of the pairs of walls 74, 75 and 76, 77. Each of the pair of spaced apart parallel flanges 74, 75 and 76, 77 has the slot 62 with notches 64 shown in FIG. 2. The pins 70 have a length sufficient such that opposite, distal ends of each pin extend through each side of the upper ends 46, 48 of the front legs 23, 25. The distal ends of each pin are then slidably captured in the slots in the respective pair of walls 74, 75 and 76, 77, such as in the same manner described above in regard to FIG. 2. If desired, one could use a single wall for each flange. However, the double wall arrangement shown in FIG. 4 provides greater strength and stability.

FIG. 5 illustrates the chair 10 in a fully folded position, with the seat back 15 and front legs 23, 25 folded substantially parallel to the seat 13. This position of the seat back 15 and front legs 23, 25 is obtained by manipulating the armrests 20, 21 to move the pins fully to the rear boundaries of the slots in the flanges.

Referring back to FIGS. 2 and 3, in addition to the adjustably slidable attachment of the front legs 23, 25 to the armrests 20, 21, each front leg 23, 25 is also pivotably attached to right 18 and left 19 edges, respectively, of the seat 13. The front legs 23, 25 are attached to respective edges 18, 19 of the seat 13 at a location intermediate the base of each leg 20, 21 and the pivotal attachment of each leg 23, 25 to the armrests 20, 21, and somewhat closer to the upper end 46, 48 of each leg 23, 25. The specific location of attachment is a function of the style of the chair, i.e., an Adirondack chair, and also takes into account the folding characteristics of the chair 10 which enable the seat back 15 and front legs 23, 25 to be folded substantially parallel to the seat 13.

The pivotal connection of the front legs 23, 25 to the left 18 and right 19 edges of the seat 13 facilitate the folding of the front legs 23, 25, along with the seat back 15, when the armrests 20, 21 are manipulated to fold the chair 10. Since the armrests 20, 21 pivotably connect the upper ends 46, 48 of the front legs 23, 25 to the seat back 15, moving the armrests 20, 21 fully forward causes both the seat back 15 and the front legs 23, 25 to fold substantially parallel to the seat 13. In this position, the seat back 15 is adjacent the top of the seat 13 and the front legs 23, 25 are adjacent the right 18 and left 19 edges of the seat 13.

To provide stackability, and to further improve compactness when the chair 10 is folded, the rear legs 27, 29 are pivotably attached to the bottom 44 of the seat 13, near the rear edge 17 and at opposite sides thereof. This permits the rear legs 27, 29 to be folded from an extended position generally perpendicular to, or at an obtuse angle to, the seat 13, as shown best in FIG. 2, to a folded position where the rear legs 27, 29 are substantially parallel to and beneath the bottom 44 of the seat 13, as shown in FIG. 6. Moreover, the rear legs 27, 29 may pivot independently of the seat back 15 and front legs 23, 25. Folding of the rear legs 27, 29 increases the compactness of the chair 10 when the seat back 15, armrests 20, 21, front legs 23, 25 are also folded.

Figure 7:
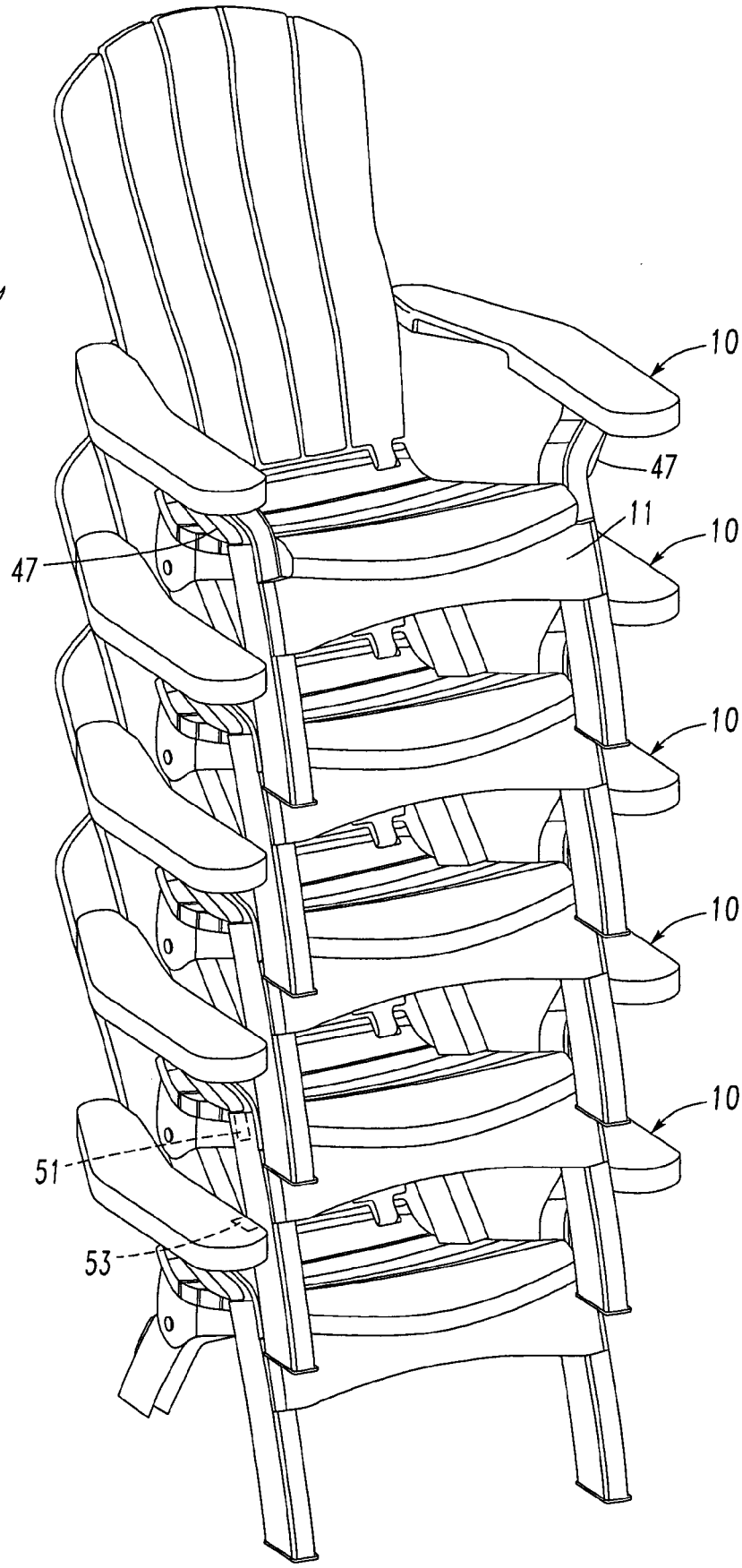
FIG. 7 is a front perspective view of five chairs of the embodiment shown in FIG. 1 stacked together.

The separately folding rear legs 27, 29 also facilitate the stacking of the chair 10 in an unfolded configuration shown in FIG. 6. The rear legs 27, 29 can be folded independently, permitting the seat back 15, armrests 20, 21 and front legs 23, 25 to each remain in the unfolded position. With only the rear legs 27, 29 folded, the chairs 10 can be stacked one upon the other, as illustrated in FIG. 7. In the stacking configuration, the seat back 15 remains in the upright position, with the front legs 23, 25 extended. The rear legs can be folded to the fully folded position shown in FIG. 6 or to an intermediate position shown in FIG. 7. Locking tabs, not shown, can be provided on the rear legs to retain the rear legs in that intermediate position. With the rear legs so positioned the chairs can be stacked such that the bottoms of the rear legs of one chair stand on the seat of the chair immediately below that chair as shown in FIG. 7. If the rear legs are fully folded as in FIG. 6, then one side of the rear legs would rest on the seat of the chair immediately below those legs and the chairs would be nested more closely together than they are shown in FIG. 7.

In the event that a person should sit on the top chair in a stack of chairs the stack should not collapse and no chairs in the stack should be damaged. Since the upper ends of the front legs curve outwardly, one does not want that curved portion to force the arms of the chair below to splay outward should the top chair be pushed too far down. The construction of the rear legs should prevent the chair from being pushed so far down that the curved portions of the front legs will engage the arms of a chair below. However, if a force is applied only to the front edge of the seat of the upper chair, that chair could tilt within the chair in which it is nested. Therefore, I prefer to provide a wing 47 having a flat bottom 47*a* extending from the upper end of each front leg. These wings can be seen most clearly in FIGS. 3 and 7. When the front of the upper chair in a stack is pushed downward, the flat bottom 47*a* of each wing 47 will rest on the top surface of an arm of the chair below. Consequently, the downward force will not cause those arms to splay outward.

I may also provide a rib 51 shown in dotted line in FIG. 7 that extends from each wing 47. This rib 51 will fit within a groove or slot 53 when the chair is fully nested locking the two chairs together. The optional ribs 51 and slot 53 are illustrated in FIG. 7 as being much larger than they would be in the actual chair so that these features can be clearly seen in the drawing.

The folding Adirondack chair 10 according to the invention thus has the advantage that multiple chairs 10 can be stacked one upon another and placed on a pallet for easy transport. A retailer can also display the stacked chairs 10 on the same pallet on which they were shipped. The ability to stack the chairs 10 is also advantageous to consumers, because stacking multiple chairs 10 one upon the other enables a more efficient use of storage space.

Additionally, as shown in FIG. 5, with both the front 23, 25 and rear 27, 29 legs folded, the chair 10 folds to a relatively compact overall size. In fact, the stackable folding chair 10 when fully folded as in FIG. 5 is sufficiently compact to fit in most family cars.

Although certain embodiments of the invention have been described in detail, it will be appreciated by those skilled in the art that various modifications to those details could be developed in light of the overall teaching of this disclosure. Accordingly, the invention is not limed to these present preferred embodiments, but may be variously embodied within the scope of the following claims.

What is claimed is:

1. A stackable folding chair comprising:

a seat having a rear edge, a right edge, a left edge and a bottom;

a seat back pivotably attached to the rear edge of the seat such that the seat back is foldable to a position substantially parallel to and on top of the seat;

a pair of front legs, one leg pivotably attached to the right edge of the seat and the other leg pivotably attached to the left edge of the seat; and a pair of rear legs pivotably attached to the bottom of the seat such that the rear legs are foldable from an extended position to a position substantially parallel to and beneath the seat;

a first armrest pivotably attached to one front leg and pivotably attached to the seat back;

a second armrest pivotably attached to the other front leg and pivotably attached to the seat back;

each of said first and second armrests slidable relative to each of said pair of front legs such that sliding said armrests relative to said front legs pivots the front legs and the seat back relative to said seat.

2. The stackable folding chair of claim 1 wherein the armrests are configured so that the seat back is locked in only one unfolded position.

3. The stackable folding chair of claim 1 wherein the armrests are configured so that the seat back can be positioned in one of at least two unfolded positions.

4. The stackable folding chair of claim 1 also comprising a wing attached to each front leg, the wing positioned and configured so that when a first stackable folding chair is stacked on a second stackable folding chair, each wing on the first chair will rest upon an armrest of the second chair.

5. The stackable folding chair of claim 1 also comprising a rib attached to each front leg and wherein the armrests each have a slot, the ribs and slots sized and positioned so that when a first stackable folding chair is stacked on a second stackable folding chair each rib will fit within the slot of an armrest of the second chair.

6. The stackable folding chair of claim 1 also comprising reinforcing bars attached to the bottom of the seat.

7. The stackable folding chair of claim 1 wherein the seat, seat back, front legs and rear legs are plastic.

8. The stackable folding chair of claim 7 wherein the plastic is selected from the group consisting of polypropylene, polyvinyl chloride, polycarbonate and ABS.

9. The stackable folding chair of claim 7 wherein at least a portion of the plastic is reinforced plastic.

10. A stackable folding chair comprising:

a seat having a left edge and a right edge, a rear edge and a bottom;

a seat back pivotably attached to the rear edge of the seat;

a pair of front legs, one leg attached to the left edge of the seat, and the other attached to the right edge;

a pair of rear legs pivotably attached to the bottom of the seat such that the rear legs are pivotable from an extended position to a folded position;

the seat, seat back, front legs and rear legs positioned and configured to enable the chair to be stacked upon one another with the rear legs pivoted to the folded position such that each chair so stacked is nested within another chair;

each of the front legs pivotably attached to respective right and left edges of the seat;

a first armrest pivotably attached to one front leg and pivotably to the seat back;

a second armrest pivotably attached other front leg and pivotably attached to the seat back;

each of said first and second armrests slidable relative to each of said pair of front legs such that sliding said armrests relative to said front legs pivots the front legs and the seat back relative to said seat; and each of said first and second armrests, the seat, seat back, front legs and rear legs positioned and configured to enable the chair to be stacked upon one another with the rear legs pivoted to the folded position such that each chair so stacked is nested within another chair.

11. A stackable folding chair comprising:

a seat having a left edge and a right edge, a rear edge and a bottom;

a seat back pivotably attached to the rear edge of the seat;

a pair of front legs, one leg attached to the left edge of the seat, and the other attached to the right edge;

a pair of rear legs pivotably attached to the bottom of the seat such that the rear legs are pivotable from an extended position to a folded position;

the seat, seat back, front legs and rear legs positioned and configured to enable the chair to be stacked upon one another with the rear legs pivoted to the folded position such that each chair so stacked is nested within another chair; and a wing attached to each front leg, the wing positioned and configured so that when a first stackable folding chair is stacked on a second stackable folding chair, each wing on the first chair will rest upon an armrest of the second chair.

12. A stackable folding chair comprising:

a seat having a left edge and a right edge, a rear edge and a bottom;

a seat back pivotably attached to the rear edge of the seat;

a pair of front legs, one leg attached to the left edge of the seat, and the other attached to the right edge;

a pair of rear legs pivotably attached to the bottom of the seat such that the rear legs are pivotable from an extended position to a folded position;

the seat, seat back, front legs and rear legs positioned and configured to enable the chair to be stacked upon one another with the rear legs pivoted to the folded position such that each chair so stacked is nested within another chair; and a rib attached to each front leg and wherein the armrests each have a slot, the ribs and slots sized and positioned so that when a first stackable folding chair is stacked on a second stackable folding chair each rib will fit within the slot of an armrest of the second chair.

* * * * *